US007380411B2

(12) United States Patent
Matsuoka et al.

(10) Patent No.: US 7,380,411 B2
(45) Date of Patent: Jun. 3, 2008

(54) HEAT SOURCE UNIT WITH SWITCHING MEANS BETWEEN HEATING AND COOLING

(75) Inventors: Shinya Matsuoka, Sakai (JP); Shinri Sada, Sakai (JP); Hiroyuki Inoue, Sakai (JP); Hiroshi Fuchikami, Sakai (JP); Atsushi Umeda, Sakai (JP)

(73) Assignee: Daikin Industries, Ltd., Osaka (JP)

( * ) Notice: Subject to any disclaimer, the term of this patent is extended or adjusted under 35 U.S.C. 154(b) by 540 days.

(21) Appl. No.: 10/508,569

(22) PCT Filed: Mar. 28, 2003

(86) PCT No.: PCT/JP03/04047

§ 371 (c)(1),
(2), (4) Date: Sep. 22, 2004

(87) PCT Pub. No.: WO03/087681

PCT Pub. Date: Oct. 23, 2003

(65) Prior Publication Data

US 2005/0150243 A1 Jul. 14, 2005

(30) Foreign Application Priority Data

Mar. 29, 2002 (JP) ..... 2002-096707

(51) Int. Cl.
*F25B 13/00* (2006.01)

(52) U.S. Cl. ..... 62/324.1; 62/324.2; 62/324.5; 62/115; 62/160; 165/97; 165/101

(58) Field of Classification Search ..... 62/324.1, 62/324.2, 324.5, 160, 115; 165/97, 101
See application file for complete search history.

(56) References Cited

U.S. PATENT DOCUMENTS 7,185,506 B2 * 3/2007 Aflekt et al. ..... 62/324.6

FOREIGN PATENT DOCUMENTS

JP H04-295568 A 10/1992
JP H10-176869 A 6/1998

* cited by examiner

*Primary Examiner*—Cheryl J. Tyler
*Assistant Examiner*—Emily Iris Nalven
(74) *Attorney, Agent, or Firm*—Global IP Counselors

(57) ABSTRACT

The present invention provides a heat source unit capable of being used in either an air conditioner for switchable cooling and heating operation or an air conditioner for simultaneous cooling and heating operation. An air conditioner principally includes one heat source unit, a plurality of utilization units, and a connecting unit provided for each utilization unit. The heat source unit uses water as the heat source, and principally includes a compressing means, a main heat exchanger, a first switching means, a main refrigerant switching means, an auxiliary heat exchanger connected in parallel with the main heat exchanger, a second switching means, an auxiliary refrigerant switching means, and a liquid receiver. The auxiliary heat exchanger is capable of switching between functioning as an evaporator and a condenser, by the second switching means.

6 Claims, 10 Drawing Sheets

HEAT SOURCE UNIT WITH SWITCHING MEANS BETWEEN HEATING AND COOLING

TECHNICAL FIELD

The present invention relates to an air conditioner heat source unit and an air conditioner, and more particularly relates to an air conditioner heat source unit including a heat source side refrigerant circuit connected to a plurality of utilization side refrigerant circuits via a connecting refrigerant circuit, and to an air conditioner.

BACKGROUND ART

Conventional air conditioners are known that are capable of switchable cooling and heating operation or simultaneous cooling and heating operation, and include a plurality of utilization units, and a heat source unit. Each utilization unit includes a utilization side refrigerant circuit that includes a utilization side heat exchanger and a utilization side expanding means. The heat source unit includes a heat source side refrigerant circuit that includes a compressing means that compresses a refrigerant, a main heat exchanger, a first switching means for making the main heat exchanger to function as an evaporator and a condenser, and a main refrigerant switching means that includes a motor operated expansion valve capable of regulating the refrigerant flow of the main heat exchanger. The utilization side refrigerant circuit and the heat source side refrigerant circuit are connected via a connecting refrigerant circuit. In such an air conditioner, the load of the heat source unit is regulated according to the load of the plurality of utilization units, and operation is performed so that the thermal balance of the entire refrigeration cycle is satisfied. For example, the air conditioner is constituted so that the main heat exchanger is actuated as the evaporator during heating operation or during simultaneous cooling and heating operation; therefore, the amount of evaporation of the refrigerant is varied in the main heat exchanger by regulating the opening of the main refrigerant switching means, thus balancing the load of the utilization units and the load of the heat source unit. At this time, the variation in the amount of evaporation of the main heat exchanger is achieved by regulating the opening of the main refrigerant switching means while fixedly maintaining the high pressure refrigerant pressure on the discharge side of the compressing means of the heat source unit. In other words, if the amount of evaporation of the refrigerant in the main heat exchanger is greater than the amount of evaporation of the refrigerant corresponding to the load of the utilization units, then the amount of evaporation of the refrigerant is reduced by restricting the opening of the main refrigerant switching means because there is a tendency for the high pressure refrigerant pressure on the discharge side of the compressing means of the heat source unit to increase. Conversely, if the amount of evaporation of the refrigerant in the main heat exchanger is less than the amount of evaporation of the refrigerant corresponding to the load of the utilization units, then the amount of evaporation of the refrigerant is increased by enlarging the opening of the main refrigerant switching means because there is a tendency for the high pressure refrigerant pressure on the discharge side of the compressing means of the heat source unit to decrease.

As an example of another conventional air conditioner, one is known that provides, inside the heat source unit, an auxiliary heat exchanger provided in parallel with the main heat exchanger and that functions as the condenser. This air conditioner is constituted so that the load of the utilization units and the load of the heat source unit are balanced by regulating the thermal balance of the entire heat source unit by actuating and stopping the auxiliary heat exchanger. In other words, if the amount of evaporation of the refrigerant in the main heat exchanger is greater than the amount of evaporation of the refrigerant corresponding to the load of the utilization units, then there is a tendency for the high pressure refrigerant pressure on the discharge side of the compressing means of the heat source unit to increase; consequently, the thermal balance of the entire heat source unit is regulated by actuating the auxiliary heat exchanger to increase the amount of condensation and to offset the amount of evaporation of the refrigerant of the main heat exchanger. Conversely, if the amount of evaporation of the refrigerant in the main heat exchanger is less than the amount of evaporation of the refrigerant corresponding to the load of the utilization units, then there is a tendency for the high pressure refrigerant pressure on the discharge side of the compressing means of the heat source unit to decrease; consequently, the thermal balance of the entire heat source unit is regulated by stopping the auxiliary heat exchanger to decrease the amount of condensation.

An air conditioner is also known that includes both the above mentioned main refrigerant switching means and the auxiliary heat exchanger. Such an air conditioner is basically constituted so that the loads of the utilization units are balanced by actuating and stopping the auxiliary heat exchanger to regulate the thermal balance of the entire heat source unit, and so that fine adjustment is performed by regulating the opening of the main refrigerant switching means.

In an air conditioner that balances the load of the utilization units and the load of the heat source unit by regulating the thermal balance via the main refrigerant switching means and the auxiliary heat exchanger of the heat source unit, the greater the condensing capacity of the auxiliary heat exchanger is with respect to the evaporative capacity of the main heat exchanger, the more the range of regulation of the heat source unit with respect to the fluctuation in the load of the utilization units is unfortunately limited. For example, if the capacity of the auxiliary heat exchanger is increased, then the fluctuations in the refrigerant pressure on the high pressure side may unfortunately increase due to actuating and stopping of the auxiliary heat exchanger. Conversely, if the capacity of the auxiliary heat exchanger is decreased, then the range over which regulation must be performed by the main refrigerant switching means unfortunately increases; consequently, it may no longer be possible to restrict the amount of evaporation of the main heat exchanger particularly if the heating load of the utilization units is small.

Thus, in a conventional air conditioner capable of switchable operation or simultaneous cooling and heating operation, it is problematic to optimize the thermal balance of the heating load of the utilization units and the evaporative performance of the heat source unit while maintaining controllability.

In addition, in the above mentioned conventional air conditioner for switchable cooling and heating operation and the air conditioner for simultaneous cooling and heating operation, the model of the utilization units is shared, but the model of the heat source unit varies, which leads to an increase in manufacturing costs.

SUMMARY OF THE INVENTION

It is an object of the present invention to provide a heat source unit capable of being used in either an air conditioner for switchable heating and cooling operation or an air conditioner for simultaneous cooling and heating operation.

According to a first aspect of the present invention, a heat source unit of an air conditioner including a heat source side refrigerant circuit connected to a plurality of utilization side refrigerant circuits via a connecting refrigerant circuit, includes a compressing means, a main heat exchanger, an auxiliary heat exchanger, a refrigerant liquid piping, a first refrigerant gas piping, a second refrigerant gas piping, a main refrigerant switching means, an auxiliary refrigerant switching means, a first switching means, and a second switching means. The compressing means compresses the refrigerant gas. The main heat exchanger functions as an evaporator and a condenser of the refrigerant. The auxiliary heat exchanger is connected in parallel with the main heat exchanger and functions as an evaporator and a condenser of the refrigerant. The refrigerant liquid piping is connected to the connecting refrigerant circuit. The first refrigerant gas piping is connected to the connecting refrigerant circuit. The second refrigerant gas piping delivers the refrigerant gas from the connecting refrigerant circuit to the intake side of the compressing means. The main refrigerant switching means is connected between the refrigerant liquid piping and the main heat exchanger. The auxiliary refrigerant switching means is connected between the refrigerant liquid piping and the auxiliary heat exchanger. The first switching means is capable of switching between the state wherein the refrigerant gas side of the main heat exchanger is connected to the discharge side of the compressing means, the intake side of the compressing means is connected to the first refrigerant gas piping, and the low pressure refrigerant gas is made to be taken into the compressing means; and the state wherein the refrigerant gas side of the main heat exchanger is connected to the intake side of the compressing means, the discharge side of the compressing means is connected to the first refrigerant gas piping, and the high pressure refrigerant gas is made to be discharged from the compressing means. The second switching means is capable of switching between the state wherein the refrigerant gas side of the auxiliary heat exchanger is connected to the discharge side of the compressing means, and the state wherein the refrigerant gas side of the auxiliary heat exchanger is connected to the intake side of the compressing means. Further, the first refrigerant gas piping is capable of flowing the refrigerant gas from the connecting refrigerant circuit to the first switching means, and of flowing the refrigerant gas from the first switching means to the connecting refrigerant circuit.

The conventional heat source unit for a simultaneous cooling and heating device is connected in parallel with the main heat exchanger, and includes an auxiliary heat exchanger that functions only as the condenser. In this heat source unit, when the plurality of utilization units principally performs cooling operation and only some of the utilization units perform low-load heating operation, operation is sometimes performed to regulate the load of the heat source unit by actuating the main heat exchanger as the condenser, and supplying the discharge refrigerant gas of the compressing means to the first refrigerant gas piping while supplying the refrigerant liquid from the refrigerant liquid piping. To enable such operation, the conventional heat source unit is provided with a delivery piping switchable by a solenoid valve for delivering a portion of the discharge refrigerant gas of the compressing means to the first refrigerant gas piping. The first refrigerant gas piping is provided with a check valve capable of only flowing the refrigerant gas from the first switching means side to the connecting refrigerant circuit side; when this delivery piping is used, the refrigerant gas on the discharge side of the compressing means does not flow from the first refrigerant gas piping to the intake side of the compressing means via the first switching means. Consequently, because the first refrigerant gas piping cannot be used as the refrigerant gas piping for the switchable cooling and heating device, the heat source unit for a conventional simultaneous cooling and heating device cannot be used as the heat source unit for the switchable cooling and heating device.

However, in the heat source unit of the air conditioner of the present invention, the auxiliary heat exchanger conventionally used only as the condenser is used as the evaporator. Specifically, it is constituted so that a second switching means is provided, which can switch so that the auxiliary heat exchanger functions as an evaporator or a condenser. Consequently, in this heat source unit, there is no need to perform the operation of supplying the discharged refrigerant gas of the compressing means to the first refrigerant gas piping while actuating the main heat exchanger as the condenser, as in the conventional heat source unit for a simultaneous cooling and heating device, and the load of the heat source unit can be regulated by actuating the main heat exchanger as the condenser and actuating the auxiliary heat exchanger as the evaporator. Consequently, there is no need in this heat source unit for the check valve of the first refrigerant gas piping and the delivery piping provided in a conventional heat source unit.

Thereby, this heat source unit of an air conditioner can be used in either the air conditioner for switchable cooling and heating operation or the air conditioner for simultaneous cooling and heating operation because, in the first refrigerant gas piping, the refrigerant gas can flow from the connecting refrigerant circuit to the first switching means, the refrigerant gas can flow from the first switching means to the connecting refrigerant circuit, and the first refrigerant gas piping can be used as the refrigerant gas piping for the switchable cooling and heating device.

According to a second aspect of the present invention, an air conditioner includes: a heat source side refrigerant circuit of the heat source unit of the first aspect of the present invention; a plurality of utilization side refrigerant circuits that each include a utilization side heat exchanger and a utilization side expanding means; and a connecting refrigerant circuit for connecting the heat source side refrigerant circuit and the utilization side refrigerant circuits; wherein, the refrigerant liquid piping of the heat source side refrigerant circuit is connected to the refrigerant liquid side of the utilization side expanding means via the connecting refrigerant circuit; the first refrigerant gas piping of the heat source side refrigerant circuit is connected so that the high pressure refrigerant gas can be delivered to the refrigerant gas side of the utilization side heat exchangers via the connecting refrigerant circuit; and the second refrigerant gas piping of the heat source side refrigerant circuit is connected so that the low pressure refrigerant gas can return from the utilization side refrigerant circuits to the heat source side refrigerant circuit via the connecting refrigerant circuit.

In this air conditioner, the refrigerant liquid piping of the heat source side refrigerant circuit, the first refrigerant gas piping, and the second refrigerant gas piping are connected to a plurality of utilization side refrigerant circuits via the connecting refrigerant circuit, and an air conditioner capable of simultaneous cooling and heating operation can consequently be constituted.

According to a third aspect of the present invention, an air conditioner includes: the heat source side refrigerant circuit of the heat source unit of the first aspect of the present invention; a plurality of utilization side refrigerant circuits that each include a utilization side heat exchanger and a utilization side expanding means; and a connecting refrigerant circuit for connecting the heat source side refrigerant circuit and the utilization side refrigerant circuits; wherein, the refrigerant liquid piping of the heat source side refrigerant circuit is connected to the refrigerant liquid side of the utilization side expanding means of the utilization side refrigerant circuits via the connecting refrigerant circuit; the first refrigerant gas piping of the heat source side refrigerant circuit is connected to the utilization side heat exchangers of the utilization side refrigerant circuits via the connecting refrigerant circuit; and the second refrigerant gas piping of the heat source side refrigerant circuit is constituted so that it is not connected to the connecting refrigerant circuit and refrigerant gas does not flow therein.

The circuit of this air conditioner is constituted so that the refrigerant liquid piping of the heat source side refrigerant circuit and the first refrigerant gas piping are connected to a plurality of utilization side refrigerant circuits via the connecting refrigerant circuit, and the second refrigerant gas piping is not connected to any circuit. Further, the refrigerant gas can flow between the heat source side refrigerant circuit and the utilization side refrigerant circuits via the first refrigerant gas piping. Thereby, an air conditioner capable of switchable cooling and heating operation can be constituted.

According to a fourth aspect of the present invention, an air conditioner includes: the heat source side refrigerant circuit of the heat source unit of the first aspect of the present invention; a plurality of utilization side refrigerant circuits that each include a utilization side heat exchanger and a utilization side expanding means; and a connecting refrigerant circuit for connecting the heat source side refrigerant circuit and the utilization side refrigerant circuits. The refrigerant liquid piping of the heat source side refrigerant circuit is connected to the refrigerant liquid side of the utilization side expanding means of each utilization side refrigerant circuit via the connecting refrigerant circuit; the second refrigerant gas piping of the heat source side refrigerant circuit is connected to the utilization side heat exchanger of some of the plurality of utilization side refrigerant circuits via the connecting refrigerant circuit. The first refrigerant gas piping of the heat source side refrigerant circuit is connected to the utilization side heat exchangers of the other utilization side refrigerant circuits via the connecting refrigerant circuit.

The circuit in this air conditioner is constituted so that a plurality of utilization side refrigerant circuits, excepting some, are connected to the refrigerant liquid piping of the heat source side refrigerant circuit and the first refrigerant gas piping via the connecting refrigerant circuit, and some of the plurality of utilization side refrigerant circuits are connected to the refrigerant liquid piping of the heat source side refrigerant circuit and the second refrigerant gas piping via the connecting refrigerant circuit. Further, some of the utilization side refrigerant circuits operate so that, regardless of the operation state of the heat source side refrigerant circuit, the refrigerant liquid from the refrigerant liquid piping or the connecting refrigerant circuit is supplied, and is made to pass through the utilization side expanding means and the utilization side heat exchangers, whereupon the low pressure refrigerant gas returns to the second refrigerant gas piping. However, the other utilization side refrigerant circuits operate so that, when the refrigerant liquid is supplied from the refrigerant liquid piping, it is made to pass through the utilization side expanding means and the utilization side heat exchangers, and then the low pressure refrigerant gas returns to the first refrigerant gas piping; and when the high pressure refrigerant gas is supplied from the first refrigerant gas piping, it is made to pass through the utilization side heat exchangers and the utilization side expanding means, and the refrigerant liquid then returns to the refrigerant liquid piping. Thereby, the air conditioner can be constituted wherein some of the plurality of utilization side refrigerant circuits are used only for cooling operation while the other utilization side refrigerant circuits can perform switchable cooling and heating operation.

According to a fifth aspect of the present invention, the air conditioner of any of the second to fourth aspects of the present invention is provided, wherein the main heat exchanger and the auxiliary heat exchanger are heat exchangers that use water as the heat source and exchange heat with the refrigerant. The water side of the main heat exchanger and the water side of the auxiliary heat exchanger are connected in series.

In this air conditioner, the refrigerant side of the main heat exchanger and the refrigerant side of the auxiliary heat exchanger are connected in parallel, but the water side is connected in series. Thereby, a sufficient amount of water can be ensured even if only the main heat exchanger exchanges heat.

According to a sixth aspect of the present invention, the air conditioner of any of the second to fifth aspects of the present invention is provided, wherein a heat source water inlet is respectively provided on the upper side of the main heat exchanger and on the upper side of the auxiliary heat exchanger; and a heat source water outlet is respectively provided on the lower side of the main heat exchanger and on the lower side of the auxiliary heat exchanger.

In this air conditioner, a water inlet is provided on the upper side of each heat exchanger, and a water outlet is provided on the lower side of each heat exchanger; consequently, the water can flow in each heat exchanger from above to below. Thereby, it becomes difficult for corrosive components and the like contained in the water to stagnate inside the heat exchanger, and scaling can be suppressed.

PREFERRED EMBODIMENTS OF THE INVENTION

First Embodiment

The following explains the first embodiment of the present invention, based on the drawings.

(1) Constitution of the Air Conditioner

Figure 1:
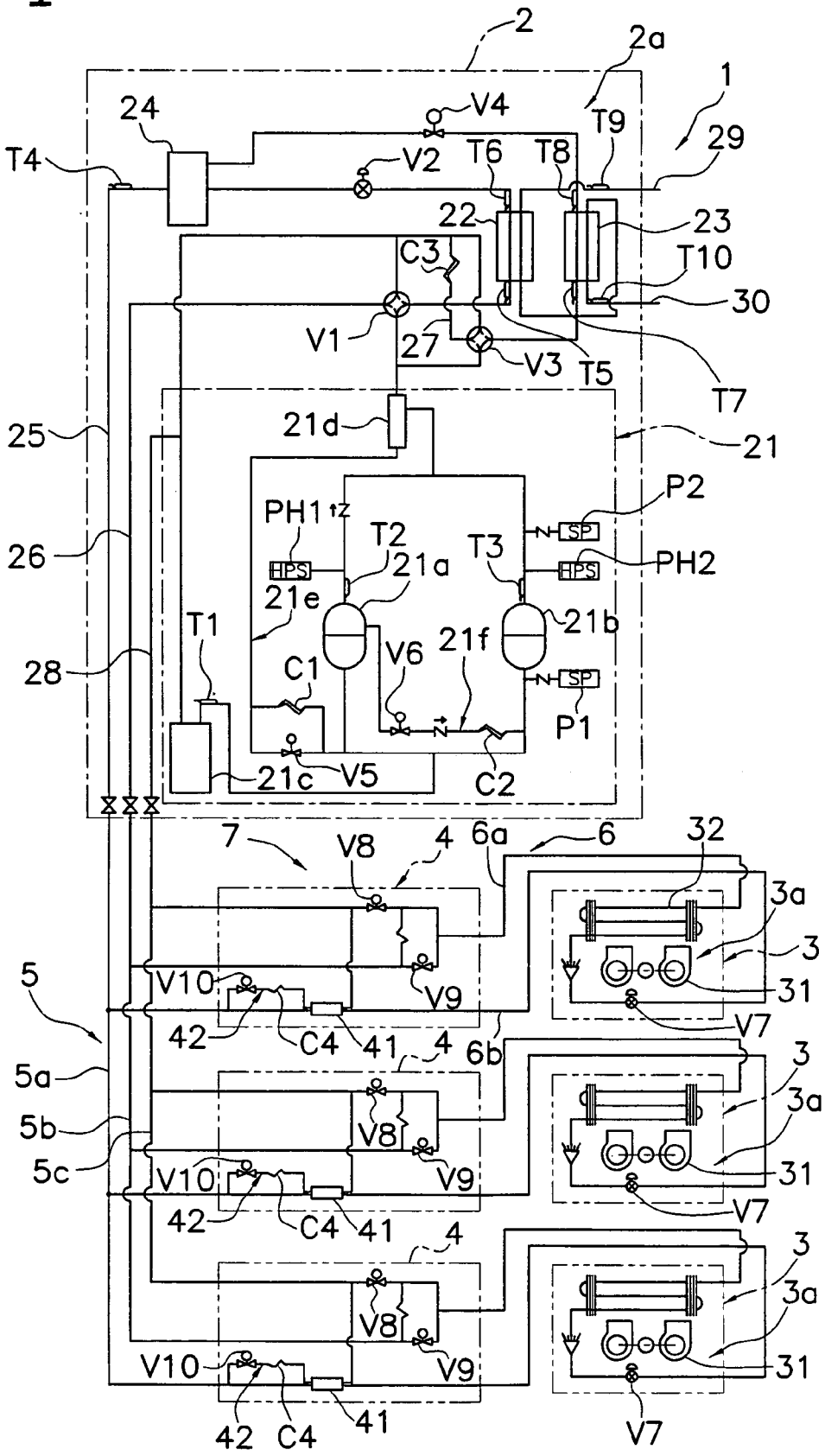
FIG. 1 is a refrigerant circuit diagram of the air conditioner according to the first embodiment of the present invention.

FIG. 1 is a refrigerant circuit diagram of an air conditioner 1 according to the first embodiment of the present invention.

The air conditioner 1 is capable of simultaneous cooling and heating operation, and includes one heat source unit 2, a plurality (three units in the present embodiment) of utilization units 3, a connecting unit 4 provided for each utilization unit 3, a first connecting piping bank 5 that connects the heat source unit 2 and the connecting units 4, and a second connecting piping bank 6 that connects the connecting units 4 and the utilization units 3.

① Heat Source Unit

The heat source unit 2 uses water as the heat source, and principally includes a compressing means 21, a main heat exchanger 22, a first switching means V1, a main refrigerant switching means V2, an auxiliary heat exchanger 23, a second switching means V3, an auxiliary refrigerant switching means V4, and a liquid receiver 24. These devices are connected by refrigerant piping, and constitute a heat source side refrigerant circuit 2*a*.

The compressing means 21 is a means for compressing the refrigerant gas, and is constituted so that a first compressor 21*a* and a second compressor 21*b* are mutually connected in parallel.

An accumulator 21*c* is provided on the intake side of each of the compressors 21*a*, 21*b*. A thermistor T1 for measuring the temperature of the refrigerant gas taken into the compressors 21*a*, 21*b* is provided at the outlet of the accumulator 21*c*. In addition, a pressure sensor P1 for measuring the pressure of the refrigerant gas taken into the compressors 21*a*, 21*b* is provided on the intake side of the second compressor 21*b*. In addition, the accumulator 21*c* is connected to the connecting units 4 via a second refrigerant gas piping 28 and the first connecting piping bank 5.

An oil separator 21*d* for separating the oil in the compressed refrigerant gas is provided on the discharge side of each of the compressors 21*a*, 21*b*. High pressure pressure switches PH1, PH2 for protecting the casing of the compressors 21*a*, 21*b* are respectively provided for each of the compressors 21*a*, 21*b* between the oil separator 21*d* and each of the compressors 21*a*, 21*b*. In addition, a pressure sensor P2 for measuring the pressure of the refrigerant gas discharged from the compressors 21*a*, 21*b* is provided on the discharge side of the second compressor 21*b*. Furthermore, thermistors T2, T3 for measuring the temperature of the refrigerant gas discharged from the compressors 21*a*, 21*b* are provided on the discharge side of each of the compressors 21*a*, 21*b*.

The refrigerant gas separated by the oil separator 21*d* flows toward the first switching means V1 and the second switching means V3, and the separated oil returns to the intake side via an oil return pipe 21*e*. The oil return pipe 21*e* includes a capillary C1 and a solenoid valve V5 mutually connected in parallel. An oil delivery piping 21*f* for supplying oil from the first compressor 21*a* toward the intake side of the second compressor 21*b* is provided between the first compressor 21*a* and the intake side of the second compressor 21*b*. The oil delivery piping 21*f* includes a solenoid valve V6 and a capillary C2 mutually connected in series.

The main heat exchanger 22 is a heat exchanger for evaporating and condensing the refrigerant, using water as the heat source. In the present embodiment, a plate heat exchanger is employed.

The main refrigerant switching means V2 including a motor operated expansion valve is provided between the refrigerant liquid side of the main heat exchanger 22 and the liquid receiver 24, and is constituted so that the amount of refrigerant flowing through the main heat exchanger 22 can be adjusted. The liquid receiver 24 is connected to the connecting units 4 via a refrigerant liquid piping 25 and the first connecting piping bank 5. The refrigerant liquid piping 25 is provided with a thermistor T4 for measuring the temperature of the refrigerant liquid. The refrigerant gas side of the main heat exchanger 22 is connected to the first switching means V1. A thermistor T5 for measuring the. refrigerant gas temperature is provided on the refrigerant gas side of the main heat exchanger 22, and a thermistor T6 for measuring the refrigerant liquid temperature is provided on the refrigerant liquid side of the main heat exchanger 22.

The first switching means V1 is a four-way switching valve that is provided to make the main heat exchanger 22 function as the evaporator and the condenser. The first switching means V1 is connected to the refrigerant gas side of the main heat exchanger 22, the accumulator 21*c* on the intake side of the compressing means 21, the oil separator 21*d* on the discharge side of the compressing means 21, and the first refrigerant gas piping 26, which is connected to the connecting units 4 via the first connecting piping bank 5. Further, when the main heat exchanger 22 is made to function as the condenser, the discharge side of the compressing means 21 and the refrigerant gas side of the main heat exchanger 22 can be connected, and the accumulator 21*c* on the intake side of the compressing means 21 and the first refrigerant gas piping 26 can be connected. Conversely, when the main heat exchanger 22 is made to function as the evaporator, the refrigerant gas side of the main heat exchanger 22 and the accumulator 21*c* on the intake side of the compressing means 21 can be connected, and the discharge side of the compressing means 21 and the first refrigerant gas piping 26 can be connected.

The auxiliary heat exchanger 23 is a heat exchanger connected in parallel to the main heat exchanger 22 for evaporating and condensing the refrigerant; in the present embodiment, a plate heat exchanger is employed, the same as for the main heat exchanger 22. The auxiliary refrigerant switching means V4 including a solenoid valve is provided between the refrigerant liquid side of the auxiliary heat exchanger 23 and the liquid receiver 24. The refrigerant gas side of the auxiliary heat exchanger 23 is connected to the second switching means V3. A thermistor T7 for measuring the refrigerant gas temperature is provided on the refrigerant gas side of the auxiliary heat exchanger 23, and a thermistor T8 for measuring the refrigerant liquid temperature is provided on the refrigerant liquid side of the auxiliary heat exchanger 23. Further, when all utilization units 3 perform heating operation, the main heat exchanger 22 and the auxiliary heat exchanger 23 are made to function as evaporators, and can handle the maximum evaporative load when all utilization units 3 perform heating operation. In the present embodiment, the evaporative capacity of the main heat exchanger 22 is set to a capacity calculated by subtracting the capacity of the auxiliary heat exchanger 23 from the maximum evaporative load.

In addition, the water that serves as the heat source is supplied from cooling tower equipment, boiler equipment, or the like, installed outside of the air conditioner 1. In the present embodiment, the heat source water is delivered from the cooling tower equipment, boiler equipment, or the like, through a water inlet piping 29 to the main heat exchanger 22, and heat exchanged with the refrigerant. This heat source water is delivered to the auxiliary heat exchanger 23, wherein the water side is connected in series with the main heat exchanger 22, and is heat exchanged with the refrigerant. Furthermore, after being used for heat exchanging with the refrigerant in the main heat exchanger 22 and the auxiliary heat exchanger 23, it returns to the cooling tower equipment, boiler equipment, or the like, via a water outlet piping 30. Herein, for each of the heat exchangers 22, 23, the water inlet is provided on the upper side of each of the heat exchangers 22, 23, and the water outlet is provided on the lower side of each of the heat exchangers 22, 23. In other words, the heat source water flows inside each of the heat exchangers 22, 23 from above to below. In addition, the water inlet piping 29 is provided with a thermistor T9 for measuring the inlet temperature of the heat source water, and the water outlet piping 30 is provided with a thermistor T10 for measuring the outlet temperature of the heat source water.

The second switching means V3 is a four-way switching valve that is provided for making the auxiliary heat exchanger 23 function as the evaporator and the condenser. The second switching means V3 is connected to the refrigerant gas side of the auxiliary heat exchanger 23, the accumulator 21 c on the intake side of the compressing means 21, the oil separator 21*d* on the discharge side of the compressing means 21, and a bypass piping 27, which is connected to the accumulator 21*c* on the intake side of the compressing means 21. The bypass piping 27 includes a capillary C3. Furthermore, when the auxiliary heat exchanger 23 is made to function as the condenser, the discharge side of the compressing means 21 and the refrigerant gas side of the auxiliary heat exchanger 23 are connected. Conversely, when the auxiliary heat exchanger 23 is made to function as the evaporator, the refrigerant gas side of the auxiliary heat exchanger 23 and the accumulator 21*c* on the intake side of the compressing means 21 are connected.

② Utilization Unit

The plurality of utilization units 3 each principally includes a fan 31, a utilization side heat exchanger 32, and a utilization side expanding means V7. These devices are connected by the refrigerant piping, which constitutes a utilization side refrigerant circuit 3*a*. The fan 31 is a device that takes in the air conditioned indoor air into the utilization unit 3, heat exchanges that air with the utilization side heat exchanger 32, and then blows it indoors. The utilization side heat exchanger 32 is a heat exchanger that functions as the condenser of the refrigerant during heating, and functions as the evaporator of the refrigerant during cooling. The utilization side expanding means V7 is a motor operated expansion valve for reducing the pressure of the refrigerant liquid during cooling. Furthermore, the utilization side refrigerant circuit 3*a* is connected to the connecting unit 4 via the second connecting piping bank 6.

③ Connecting Unit

The plurality of connecting units 4 each principally includes a subcooling heat exchanger 41. When each utilization unit 3 performs cooling operation, the connecting unit 4 can supply the refrigerant liquid supplied from the refrigerant liquid piping 25 of the heat source side refrigerant circuit 2*a* via the first connecting piping bank 5 to the utilization side expanding means V7 of the utilization side refrigerant circuit 3*a*, and can return the refrigerant gas evaporated by the utilization side heat exchanger 32 to the second refrigerant gas piping 28 through a solenoid valve V8 and the first connecting piping bank 5; when each utilization unit 3 performs heating operation, the connecting unit 4 can supply the refrigerant gas supplied from the first refrigerant gas piping 26 of the heat source side refrigerant circuit 2*a* through the first connecting piping bank 5 and a solenoid valve V9 to the utilization side heat exchanger 32 of the utilization side refrigerant circuit 3*a*, and can return the refrigerant liquid condensed by the utilization side heat exchanger 32 to the refrigerant liquid piping 25 through the subcooling heat exchanger 41 and the first connecting piping bank 5. The subcooling heat exchanger 41 is a device for, when each utilization unit 3 performs simultaneous cooling and heating operation, delivering a portion of the refrigerant liquid that returns to the refrigerant liquid piping 25 to the subcooling heat exchanger 41 through the pressure reducing piping 42, and subcooling the refrigerant liquid that returns to the refrigerant liquid piping 25. A portion of the refrigerant liquid introduced to this subcooling heat exchanger 41 is evaporated by the heat exchanging, and returns to the heat source side refrigerant circuit 2*a* through the first connecting piping bank 5 and the second refrigerant gas piping 28. The pressure reducing piping 42 is connected in series with a solenoid valve V10 and a capillary C4.

Herein, the first connecting piping bank 5 includes a refrigerant liquid connecting piping 5*a* that connects the refrigerant liquid piping 25 of the heat source unit 2 and the subcooling heat exchanger 41 of each connecting unit 4, a first refrigerant gas connecting piping 5*b* that connects the first refrigerant gas piping 26 of the heat source unit 2 and the solenoid valve V9 of each connecting unit 4, and a second refrigerant gas connecting piping 5*c* that connects the second refrigerant gas piping 28 of the heat source unit 2 and the solenoid valve V8 of each connecting unit 4. The second connecting piping bank 6 includes a third refrigerant gas connecting piping 6*a* that connects solenoid valves V8, V9 of each connecting unit 4 and the utilization side heat exchanger 32 of each utilization unit 3, and a second refrigerant liquid connecting piping 6*b* that connects the subcooling heat exchanger 41 of each connecting unit 4 and the utilization side expanding means V7 of each utilization unit 3. The above mentioned first connecting piping bank 5, the refrigerant circuit of connecting units 4, and the second connecting piping bank 6 constitute a connecting refrigerant circuit 7.

As described above, the heat source side refrigerant circuit 2*a* and the utilization side refrigerant circuits 3*a* are connected via a connecting refrigerant circuit 7, thus constituting the refrigerant circuit of the air conditioner 1 capable of simultaneous cooling and heating operation.

(2) Operation of the Air Conditioner

The following explains the operation of the air conditioner 1 of the present embodiment.

Depending on the cooling and heating load of the utilization units 3, the air conditioner 1 of the present embodiment can switch among the heating operation mode that performs heating operation of all utilization units 3, the low load heating operation mode for the case wherein the heating operation load is small, a simultaneous heating and cooling operation mode for the case of combining a utilization unit 3 that performs heating operation with a utilization unit 3 that performs cooling operation, and a cooling operation mode that performs cooling operation of all utilization units 3.

① Heating operation mode

Figure 2:
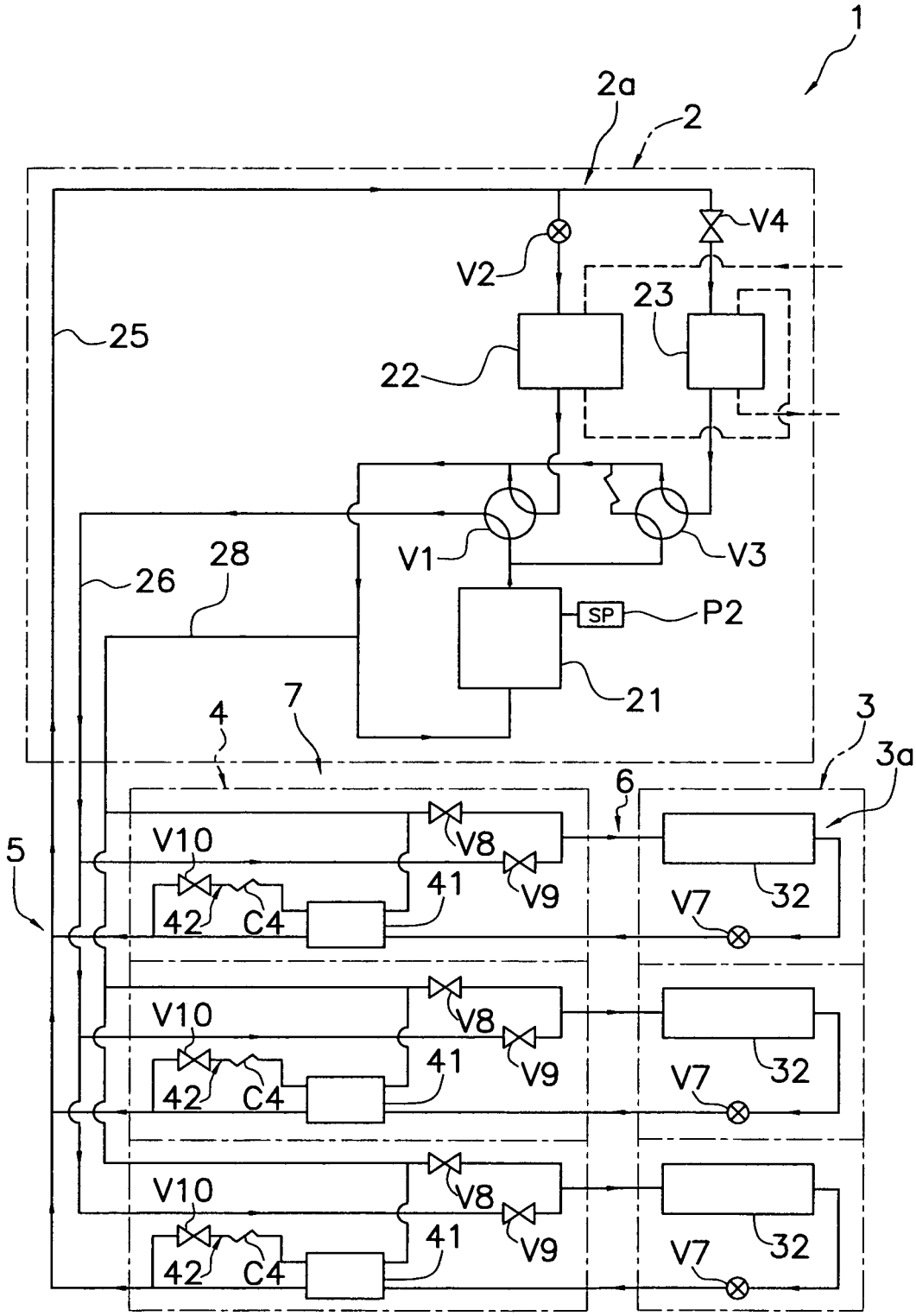
FIG. 2 is a view that depicts the main components of a refrigerant circuit of the air conditioner according to the first embodiment, and explains a heating operation mode.

When all utilization units 3 perform heating operation, the refrigerant circuit of the air conditioner 1 is constituted as shown in FIG. 2 (the refrigerant flow is shown in the figure by the arrow).

Specifically, in the heat source side refrigerant circuit 2*a* of the heat source unit 2, the first switching means VI and the second switching means V3 switch as shown in FIG. 2, and the main heat exchanger 22 and the auxiliary heat exchanger 23 are actuated as evaporators by the main refrigerant switching means V2 and the auxiliary refrigerant switching means V4 transitioning to the open state. In the utilization side refrigerant circuit 3*a* of each of the utilization units 3, the utilization side heat exchanger 32 for heating the indoors is actuated as the condenser of the refrigerant by the utilization side expanding means V7 transitioning to the open state. In each connecting unit 4, the solenoid valves V8, V10 transition to the closed state, and the solenoid valve V9 transitions to the open state.

In the constitution of such a refrigerant circuit, the refrigerant gas compressed by the compressing means 21 is delivered to the connecting unit 4 via the first switching means V1, the first refrigerant gas piping 26, and the first connecting piping bank 5. Further, this refrigerant gas is delivered to the utilization side heat exchanger 32 via the solenoid valve V9, and becomes refrigerant liquid by heat exchanging with the indoor air. This refrigerant liquid is delivered to the subcooling heat exchanger 41 via the utilization side expanding means V7. Further, this subcooled refrigerant liquid is delivered to the main heat exchanger 22 and the auxiliary heat exchanger 23 via the refrigerant liquid piping 25, the main refrigerant switching means V2, and the auxiliary refrigerant switching means V4. The refrigerant liquid delivered to the main heat exchanger 22 and the auxiliary heat exchanger 23 is evaporated, and then delivered to the intake side of the compressing means 21 via the first switching means V1 and the second switching means V3.

② Low Load Heating Operation Mode

Next, if the heating operation load of the utilization units 3 decreases, then the evaporative load on the heat source unit 2 side becomes excessive, and the high pressure side refrigerant pressure (pressure sensor P2) on the discharge side of the compressing means 21 rises. In contrast, in the state of the refrigerant circuit shown in FIG. 2, the main refrigerant switching means V2 is gradually closed, the amount of evaporation of the refrigerant in the main heat exchanger 22 decreases to prevent an increase in the refrigerant pressure (pressure sensor P2) on the high pressure side.

Figure 3:
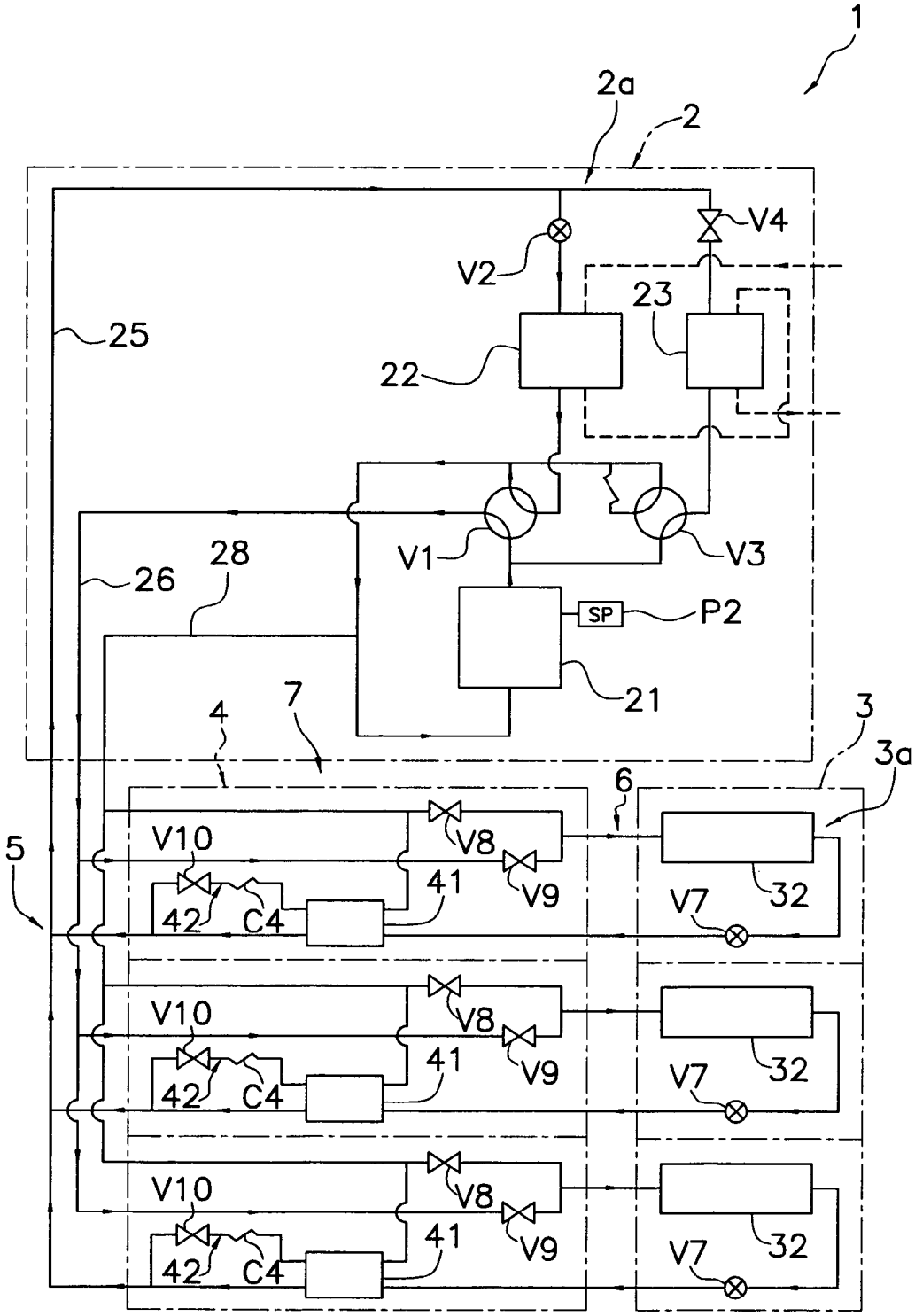
FIG. 3 is a view that depicts the main components of the refrigerant circuit of the air conditioner according to the first embodiment, and explains a low load heating operation mode.

Furthermore, at the point in time when the heating operation load of the utilization units 3 decreases and the main refrigerant switching means V2 is restricted to a prescribed opening, the refrigerant circuit of the air conditioner 1 switches as shown in FIG. 3 (the refrigerant flow is shown in the figure by the arrow).

Specifically, in the heat source side refrigerant circuit 2*a* of the heat source unit 2, the auxiliary refrigerant switching means V4 is shut off, the auxiliary heat exchanger 23 is stopped, whereupon the second switching means V3 then switches as shown in FIG. 3, and the auxiliary heat exchanger 23 can be reactivated as the condenser when the auxiliary refrigerant switching means V4 transitions to the open state.

In the constitution of such a refrigerant circuit, the refrigerant pressure of the discharge side of the compressing means 21 tends to decline because the amount of evaporation of the refrigerant decreases stepwise attendant with the stopping of the auxiliary heat exchanger 23. In contrast, an attempt is made to increase the amount of evaporation of the refrigerant in the main heat exchanger 22 by opening the main refrigerant switching means V2. Thereby, the evaporative load of the heat source unit 2 and the heating load of the utilization units 3 balance, and the refrigerant pressure on the discharge side of the compressing means 21 stabilizes.

Figure 4:
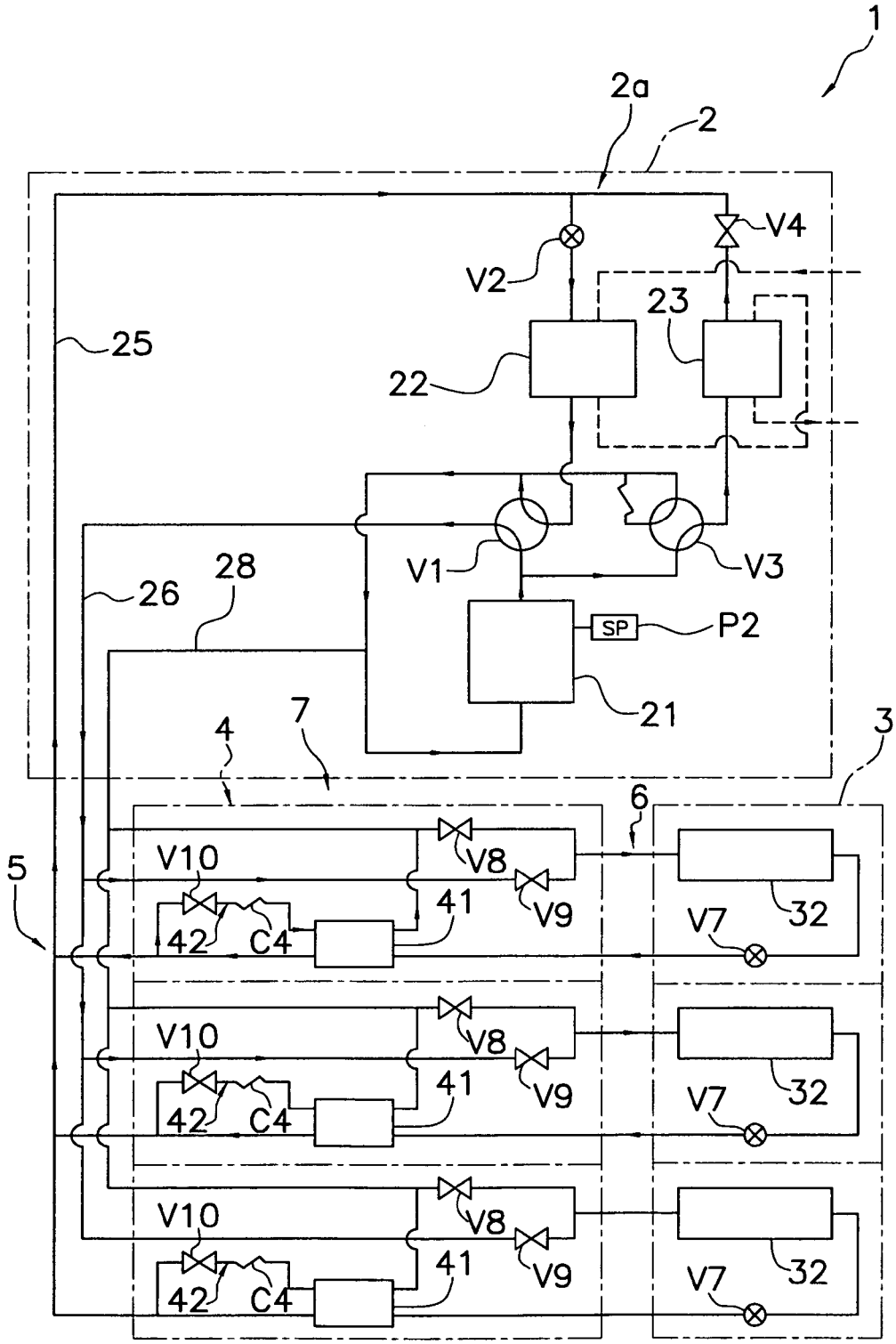
FIG. 4 is a view that depicts the main components of the refrigerant circuit of the air conditioner according to the first embodiment, and explains a low load heating operation mode.

Furthermore, if the heating operation load of the utilization units 3 decreases (e.g., if one among three utilization units 3 stops), then the evaporative load on the heat source unit 2 side becomes excessive, leading to a tendency for the refrigerant pressure on the high pressure side to increase. In contrast, the opening of the main refrigerant switching means V2 is once again restricted, and the amount of evaporation of the refrigerant in the main heat exchanger 22 is decreased, thereby preventing an increase in the refrigerant pressure on the high pressure side. Furthermore, at the point in time when the main refrigerant switching means V2 is once again restricted to a predetermined opening, the refrigerant circuit of the air conditioner 1 switches as shown in FIG. 4 (the refrigerant flow is shown in the figure by the arrow).

Specifically, in the heat source side refrigerant circuit 2*a* of the heat source unit 2, the auxiliary refrigerant switching means V4 transitions to the open state, a portion of the refrigerant gas discharged from the compressing means 21 is delivered via the second switching means V3 to the auxiliary heat exchanger 23, which is actuated as the condenser. Only one unit of the utilization units 3 performs heating operation, and the other two units are stopped by shutting off the utilization side expanding means V7 and the solenoid valves V9.

In the constitution of such a refrigerant circuit, actuating the auxiliary heat exchanger 23 as the condenser causes the amount of condensation of the refrigerant to increase stepwise, and the amount of evaporation to decrease relatively; consequently, the refrigerant pressure on the discharge side of the compressing means 21 tends to decrease. In contrast, an attempt is made to increase the amount of evaporation of the refrigerant in the main heat exchanger 22 by opening the main refrigerant switching means V2. Thereby, the evaporative load of the heat source unit 2 and the heating load of the utilization unit 3 can be balanced, and the refrigerant pressure on the discharge side of the compressing means 21 can be stabilized. Subsequently, if the heating operation load of the utilization units 3 further decreases (e.g., if two units among the three units of utilization units 3 stop), then the opening of the main refrigerant switching means V2 once again is restricted and the amount of evaporation of the refrigerant in the main heat exchanger 22 is reduced, thereby balancing the heating load of the utilization units 3 and the evaporative load of the heat source unit 2.

③ Simultaneous Heating and Cooling Operation Mode

Figure 5:
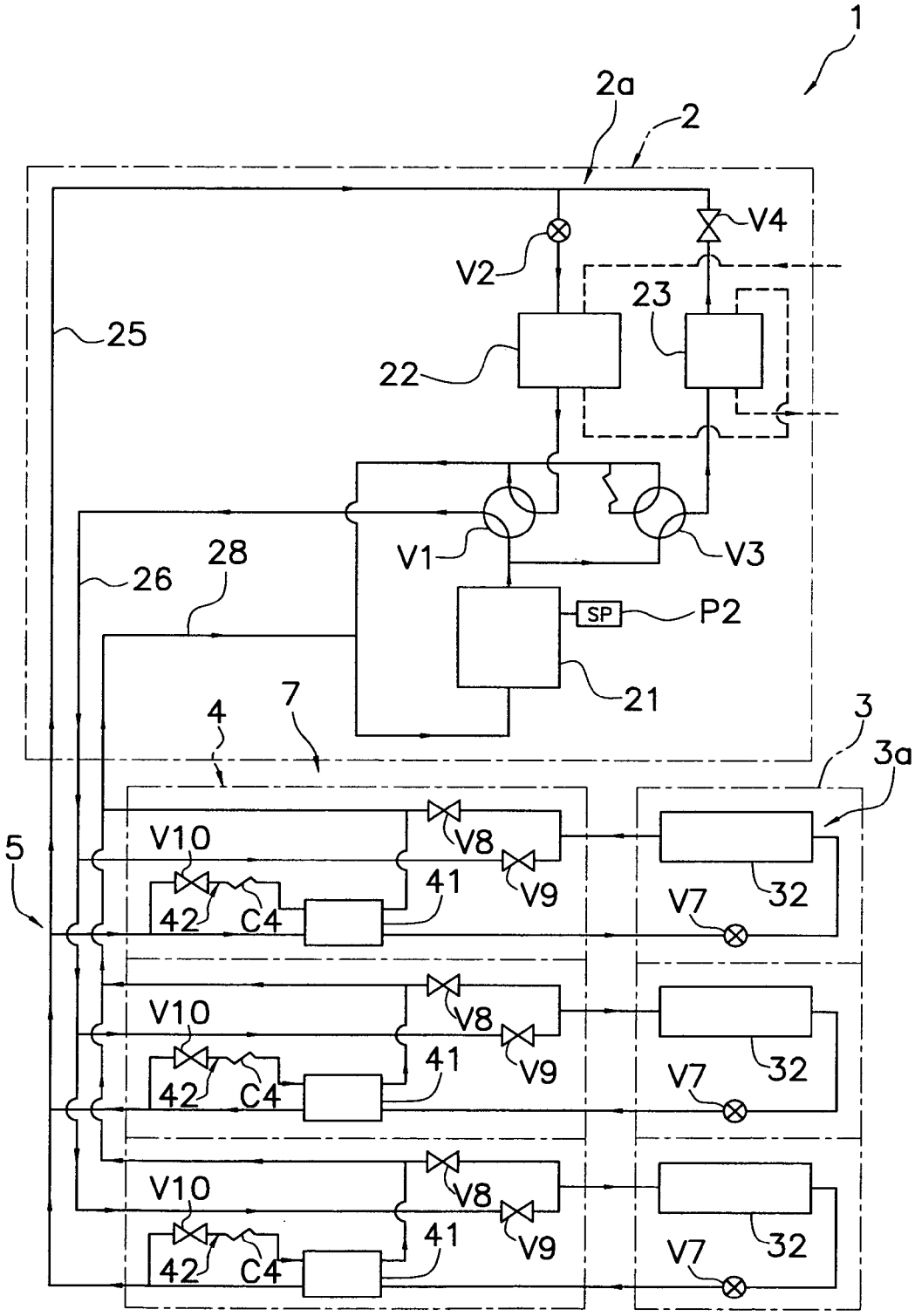
FIG. 5 is a view that depicts the main components of the refrigerant circuit of the air conditioner according to the first embodiment, and explains a simultaneous cooling and heating operation mode.

Herein, the case will now be explained wherein one unit among the three units of utilization units 3 performs cooling operation, and the other two units perform heating operation. In this operation mode, the refrigerant circuit of the air conditioner 1 is constituted as shown in FIG. 5 (the refrigerant flow is shown in the figure by the arrow).

Specifically, in the heat source side refrigerant circuit 2*a* of the heat source unit 2, the main heat exchanger 22 is actuated as the evaporator, and the auxiliary heat exchanger 23 is actuated as the condenser, the same as the constitution of the refrigerant circuit of the low load heating operation mode in FIG. 4. The utilization units 3 are constituted so that, in the utilization side refrigerant circuit 3*a* of the utilization unit 3 that performs cooling operation, the utilization side expanding means V7 can be actuated as a pressure reducing valve, and the utilization side heat exchangers 32 for cooling the indoors can be actuated as the evaporator of the refrigerant. In the refrigerant circuit of the connecting unit 4, the solenoid valve V8 transitions to the open state, and the solenoid valves V9, V10 transition to the closed state.

In the constitution of such a refrigerant circuit, the refrigerant gas compressed by the compressing means 21 is bifurcated into a portion delivered to the connecting units 4 via the first switching means VI, the first refrigerant gas piping 26, and the first connecting piping bank 5, and a portion delivered to the auxiliary heat exchanger 23 via the second switching means V3. Furthermore, the refrigerant gas delivered to the connecting units 4 is delivered via the solenoid valves V9 to the utilization side heat exchanger 32 of the utilization side refrigerant circuit 3*a* of each of the two units of utilization units 3 that perform heating operation, and heat exchanged with the indoor air, thereby condensing and forming the refrigerant liquid. This refrigerant liquid is delivered to the subcooling heat exchangers 41 via the utilization side expanding means V7, and subcooled by the subcooling heat exchangers 41. Furthermore, this subcooled refrigerant liquid is delivered to the main heat exchanger 22 via the refrigerant liquid piping 25 and the main refrigerant switching means V2. Furthermore, the pressure of a portion of the refrigerant liquid subcooled by the subcooling heat exchangers 41 is reduced by the pressure reducing piping 42, then delivered to the subcooling heat exchangers 41 where it is heat exchanged and evaporated, and delivered to the intake side of the compressing means 21 via the first connecting piping bank 5 and the second refrigerant gas piping 28. The refrigerant gas delivered to the auxiliary heat exchanger 23 is condensed by the auxiliary heat exchanger 23, and then merged on the liquid side of the main heat exchanger 22 via the auxiliary refrigerant switching means V4. Furthermore, the merged refrigerant liquid is evaporated by the main heat exchanger 22, and then delivered to the intake side of the compressing means 21 via the first switching means V1. However, in the utilization side refrigerant circuit 3*a* of the utilization unit 3 that performs cooling operation, a portion of the refrigerant liquid condensed in the other two units of utilization side refrigerant circuits 3*a* performing heating operation and that returns to the heat source side refrigerant circuit 2*a* through the refrigerant liquid piping 25 is delivered to the utilization side heat exchanger 32 via the utilization side expanding means V7 of the utilization side refrigerant circuit 3*a* of the utilization unit 3, and heat exchanges with the indoor air, thereby evaporating and forming refrigerant gas. This refrigerant gas returns to the second refrigerant gas piping 28 via the solenoid valve V8.

④ Cooling Operation Mode

Figure 6:
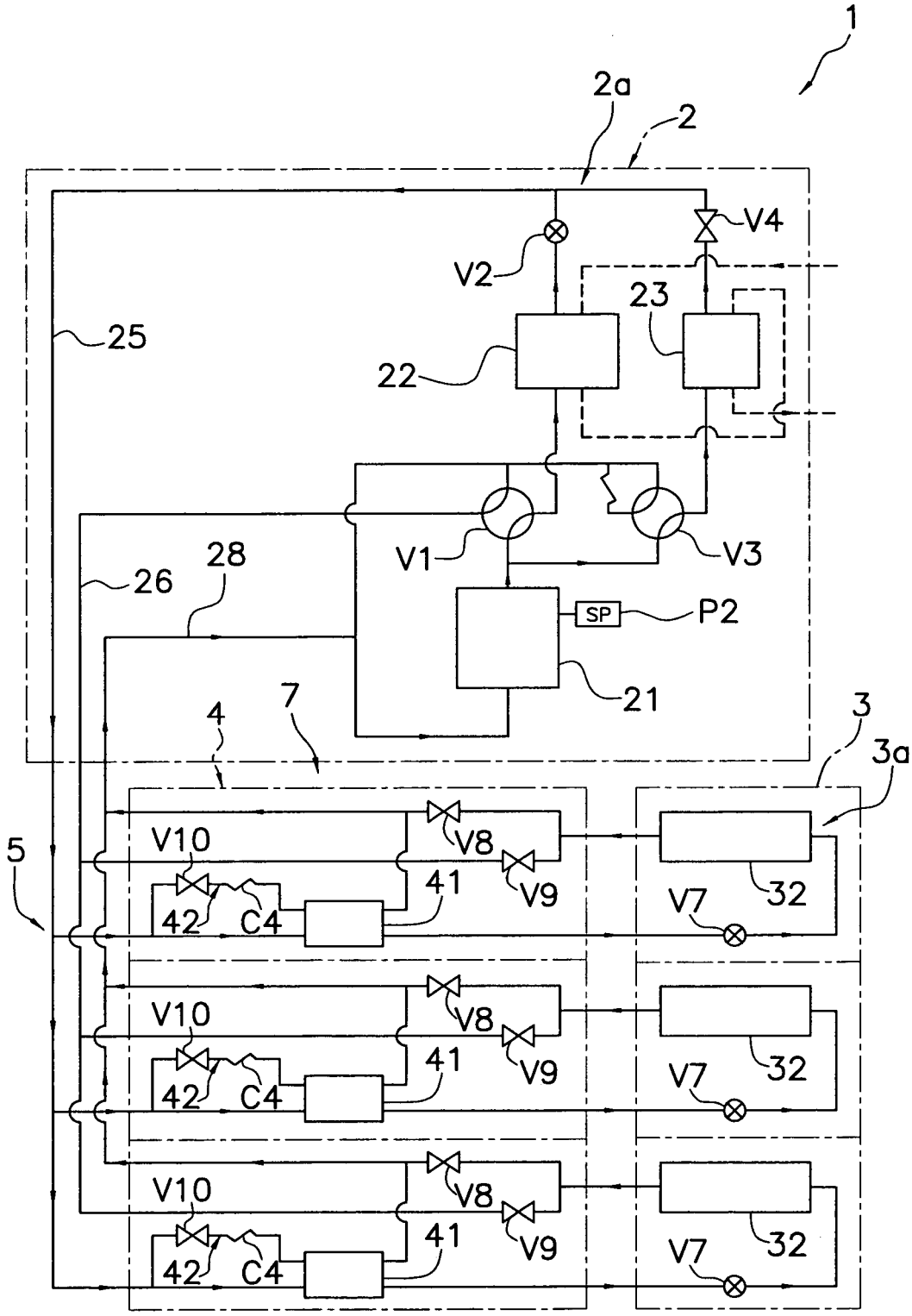
FIG. 6 is a view that depicts the main components of the refrigerant circuit of the air conditioner according to the first embodiment, and explains a cooling operation mode.

When all utilization units 3 perform cooling operation, the refrigerant circuit of the air conditioner 1 is constituted as shown in FIG. 6 (the refrigerant flow is shown in the figure by the arrow).

Specifically, in the heat source side refrigerant circuit 2*a* of the heat source unit 2, the first switching means V1 and the second switching means V3 switch as shown in FIG. 6, and the main refrigerant switching means V2 and the auxiliary refrigerant switching means V4 transition to the open state, thereby making the main heat exchanger 22 and the auxiliary heat exchanger 23 function as condensers. In the utilization side refrigerant circuits 3*a* of the utilization units 3, the utilization side expanding means V7 transitions to the open state, thereby making each of the utilization side heat exchangers 32 to function as evaporators of the refrigerant in order to cool the indoors. In the refrigerant circuits of the connecting units 4, the solenoid valves V8 transition to the open state, and the solenoid valves V9, V10 transition to the closed state.

In the constitution of such a refrigerant circuit, the refrigerant gas compressed by the compressing means 21 is delivered to the main heat exchanger 22 and the auxiliary heat exchanger 23 via the first switching means V1 and the second switching means V3, and condensed. Furthermore, this refrigerant liquid is delivered to the connecting unit 4 via the refrigerant liquid piping 25 and the first connecting piping bank 5. Furthermore, the pressure of this refrigerant liquid is reduced by the utilization side expanding means V7, and then delivered to the utilization side heat exchangers 32, where it is evaporated by heat exchanging with the indoor air to form a refrigerant gas. This refrigerant gas is delivered to the intake side of the compressing means 21 via the solenoid valves V8 and the second refrigerant gas piping 28.

(3) Features of the Air Conditioner

The air conditioner 1 of the present embodiment has the following features.

① Constitution of the Refrigerant Circuit Capable of Making the Auxiliary Heat Exchanger Function as the Evaporator In the air conditioner 1 of the present embodiment, the auxiliary heat exchanger conventionally used only as the condenser is used as the evaporator (refer to FIG. 2). Specifically, the second switching means V3 is provided, which is constituted so that the auxiliary heat exchanger 23 can be switched between functioning as the evaporator and the condenser. Thereby, if the main heat exchanger 22 is actuated as the evaporator, as during heating operation or during simultaneous cooling and heating operation, then it becomes possible to make the auxiliary heat exchanger 23 function as the evaporator, and a design can be effected so that the maximum evaporative load needed when all utilization units 3 perform heating operation can be made to correspond to the total evaporative capacity of the evaporative capacity of the main heat exchanger 22 and the evaporative capacity of the auxiliary heat exchanger 23. Namely, because it is no longer necessary for just the evaporative capacity of the main heat exchanger 22 to correspond to the evaporative load when all utilization units 3 are performing heating operation, as in the conventional case, the evaporative capacity of the main heat exchanger 22 can be reduced, thus enabling a reduction in the lower limit of the evaporative load that can be regulated by the main refrigerant switching means V2. Thereby, the range of regulation of the evaporative load of the heat source unit 2 widens, making it possible to optimize the thermal balance between the heating load of the utilization units 3 and the evaporative load of the heat source unit 2 during heating operation or during simultaneous cooling and heating operation.

In addition, by reducing the evaporative capacity of the main heat exchanger 22, the total heat exchange capacity of the main heat exchanger 22 and the auxiliary heat exchanger 23 decreases more than the total heat exchange capacity of a conventional heat source unit. Thereby, a reduction in the cost and the space requirement of the apparatus is achieved.

② Constitution Wherein the Water Side of the Main Heat Exchanger and the Water Side of the Auxiliary Heat Exchanger are Connected in Series In the air conditioner 1 of the present embodiment, the refrigerant side of the main heat exchanger 22 and the refrigerant side of the auxiliary heat exchanger 23 are connected in parallel, but the water side is connected in series. Thereby, a sufficient amount of water can be ensured even if only the main heat exchanger 22 is operating.

③ Structure Provided on the Upper Side of the Water Inlets of the Main Heat Exchanger and the Auxiliary Heat Exchanger Because the air conditioner 1 of the present embodiment has a structure wherein a water inlet is provided on the upper side of, and a water outlet is provided on the lower side of each of the heat exchangers 22, 23, water can flow inside each of the heat exchangers 22, 23 from above to below. Thereby, it becomes difficult for corrosive components and the like contained in the water to stagnate inside the heat exchangers 22, 23, and scaling can be suppressed.

④ Constitution Wherein the Wain Heat Exchanger and the Auxiliary Heat Exchanger are made Plate Heat Exchangers Because the air conditioner 1 of the present embodiment employs plate heat exchangers for the heat exchangers 22, 23, the heat source unit 2 can be made more compact compared with the case of using a double pipe type heat exchanger and the like.

Second Embodiment

Figure 7:
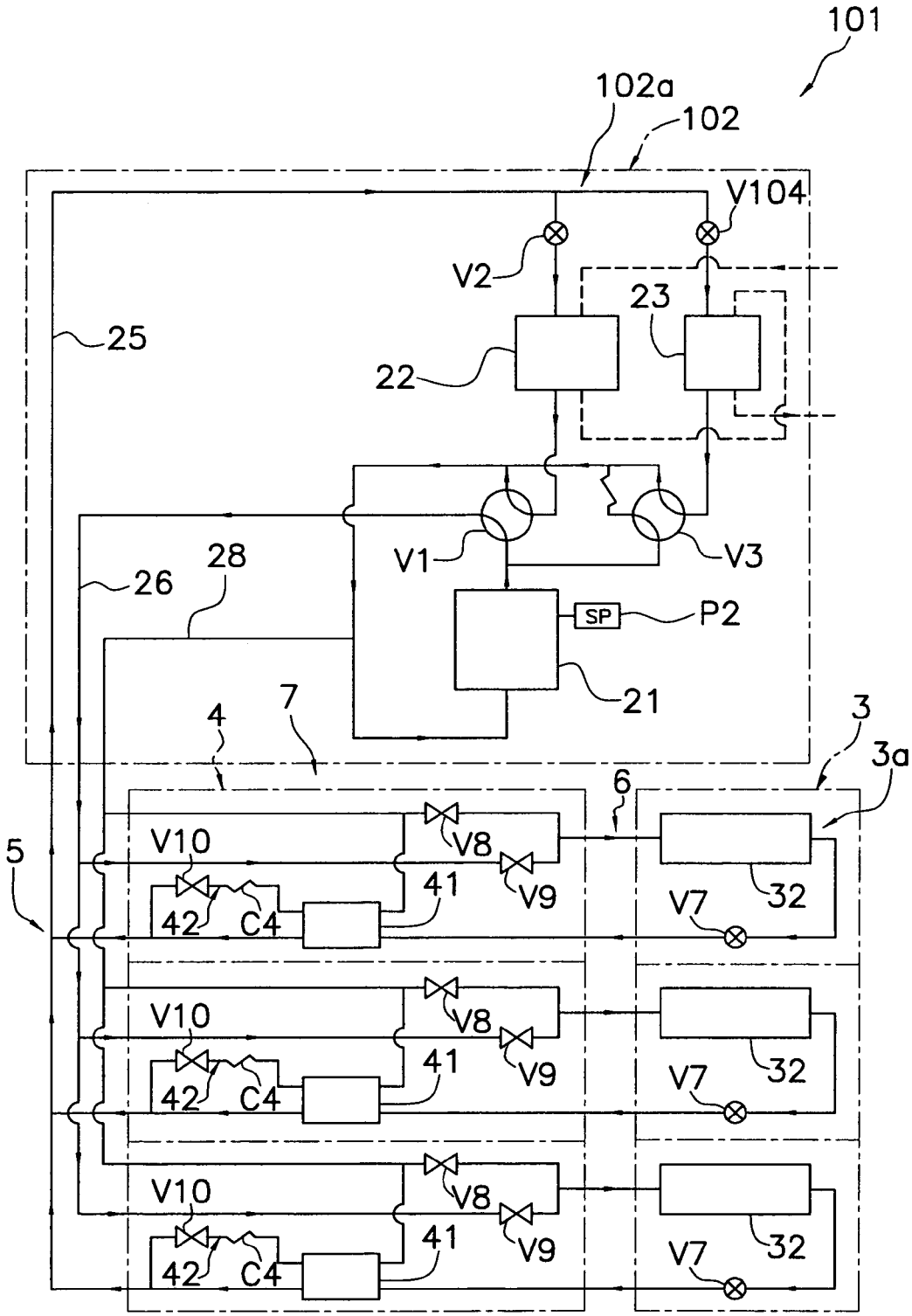
FIG. 7 is a view that depicts the main components of the refrigerant circuit of the air conditioner according to the second embodiment of the present invention, and corresponds to FIG. 2.

FIG. 7 is a view that depicts the main components of the refrigerant circuit of an air conditioner 101 according to the second embodiment of the present invention.

The basic constitution of the air conditioner 101 is the same as the air conditioner 1 of the first embodiment, with a difference only in that the solenoid valve employed as the auxiliary refrigerant switching means V4 in the first embodiment is changed to the motor operated expansion valve capable of controlling the refrigerant flow. Thereby, the air conditioner 101 of the present embodiment has features the same as those of the air conditioner 1 of the first embodiment, and also has the following features.

Because the air conditioner 101 of the present embodiment employs a motor operated expansion valve capable of controlling the refrigerant flow in an auxiliary refrigerant switching means V104 of a heat source side refrigerant circuit 102*a*, the amount of evaporation and amount of condensation of the auxiliary heat exchanger 23 can be continuously regulated. Thereby, the stepwise changes in the amount of evaporation and amount of condensation of the refrigerant due to the activation and stopping of the auxiliary heat exchanger 23 can be reduced, and the fluctuations in the pressure on the discharge side of the compressing means 21 can be suppressed.

Third Embodiment

Figure 8:
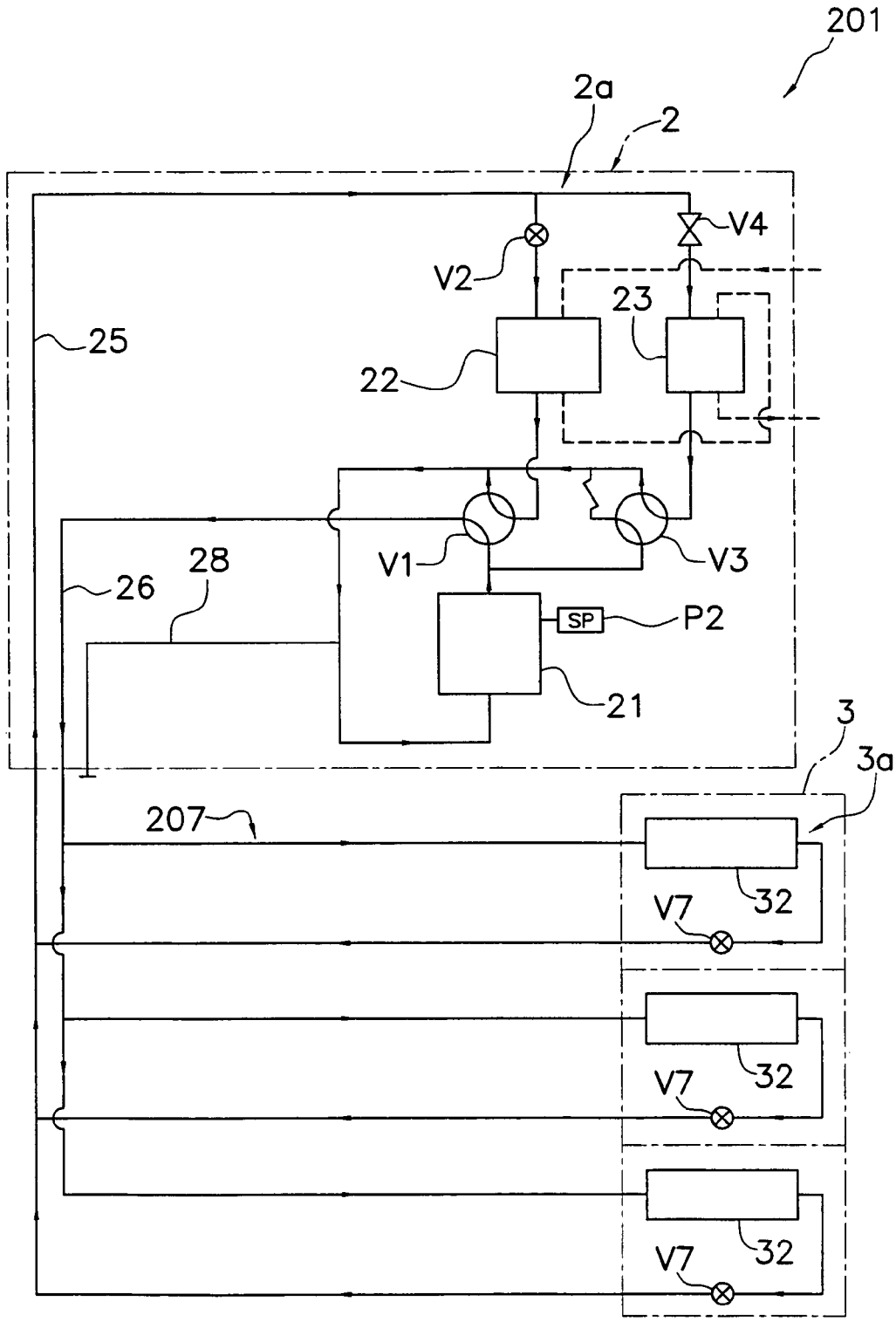
FIG. 8 is a view that depicts the main components of the refrigerant circuit of the air conditioner according to the third embodiment of the present invention, and corresponds to FIG. 2.

FIG. 8 is a view that depicts the main components of the refrigerant circuit of an air conditioner 201 according to the third embodiment of the present invention.

The air conditioner 201 uses the heat source unit 2 for the simultaneous cooling and heating device of the first embodiment as the heat source unit for the switchable cooling and heating device. Herein, the constitution of the heat source unit 2 and the utilization units 3 is the same as that of the first embodiment. In addition, the connecting units 4 for the simultaneous cooling and heating device are eliminated. Further, the first refrigerant gas piping 26 of the heat source unit 2 and the utilization side heat exchangers 32 of the utilization units 3 are connected via a connecting refrigerant circuit 207, and the refrigerant liquid piping 25 of the heat source unit 2 and the utilization side expanding means V7 of the utilization units 3 are connected via the connecting refrigerant circuit 207. Herein, the second refrigerant gas piping 28 is not used because it is not needed for the switchable cooling and heating device.

Figure 9:
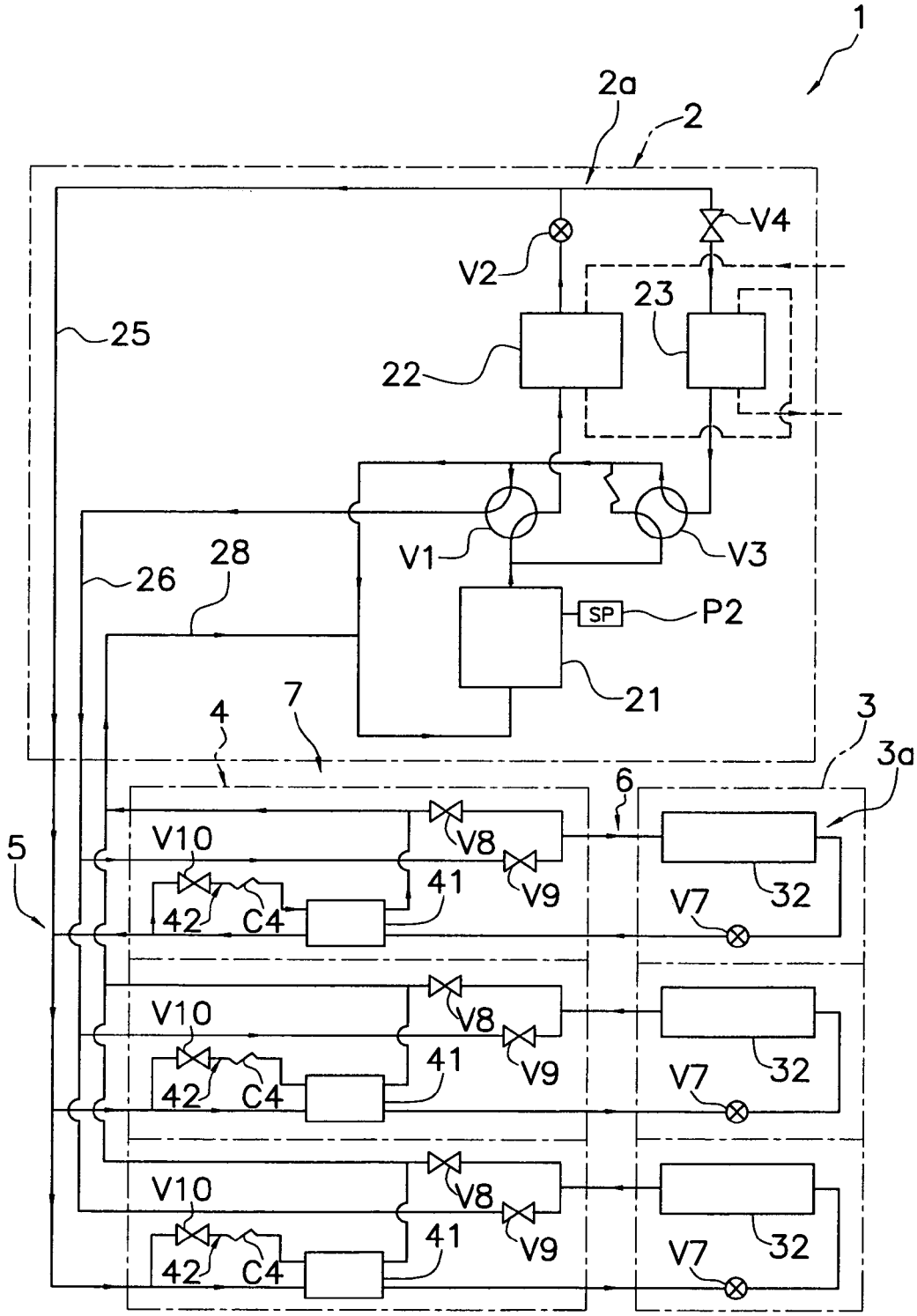
FIG. 9 is a view that depicts the main components of the refrigerant circuit of the air conditioner according to the first embodiment of the present invention, and explains the state wherein the main heat exchanger is actuated as the condenser and the auxiliary heat exchanger is actuated as the evaporator.

In the heat source unit 2 of the air conditioner 201, the auxiliary heat exchanger 23 conventionally used only as the condenser can also be used as the evaporator. Consequently, it is not necessary in this heat source unit 2 to perform the operation of supplying the refrigerant gas discharged from the compressing means to the first refrigerant gas piping while actuating the main heat exchanger 22 as the condenser, as in the heat source unit for the conventional simultaneous cooling and heating device, and the load of the heat source unit 2 can be regulated by actuating the main heat exchanger 22 as the condenser and actuating the auxiliary heat exchanger 23 as the evaporator. Consequently, the check valve provided in the first refrigerant gas piping of the conventional heat source unit is not needed in this heat source unit 2 (refer to FIG. 9).

Thereby, the heat source unit 2 of this air conditioner can be used either as the air conditioner for switchable cooling and heating operation or as the air conditioner for simultaneous cooling and heating operation because, in the first refrigerant gas piping 26, the refrigerant gas from the connecting refrigerant circuit 207 can be flowed to the first switching means V1, the refrigerant gas from the first switching means V1 can be flowed to the connecting refrigerant circuit 207, and the first refrigerant gas piping 26 can thereby be used as the refrigerant gas piping for the switchable cooling and heating device.

Fourth Embodiment

Figure 10:
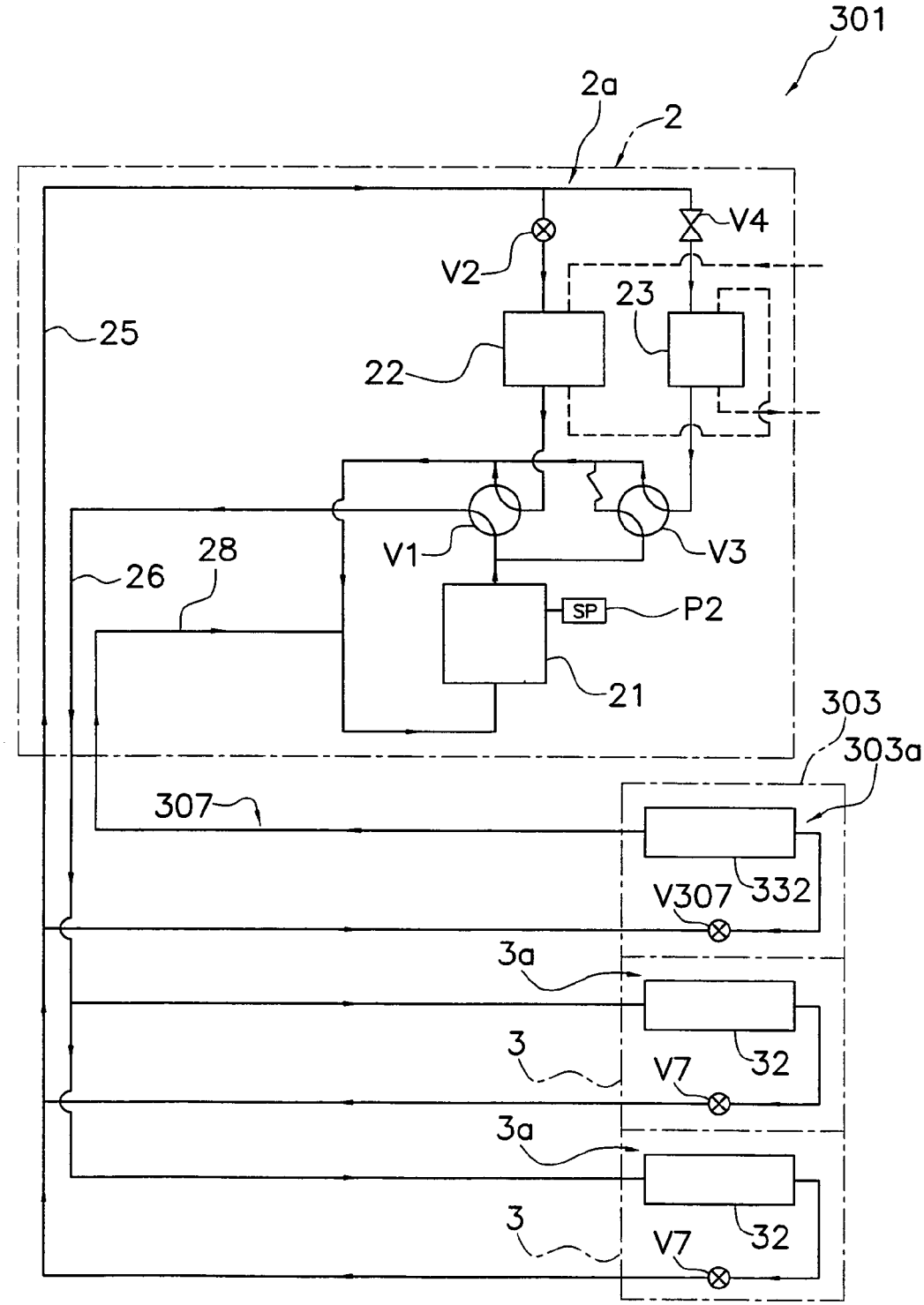
FIG. 10 is a view that depicts the main components of the refrigerant circuit of the air conditioner according to the fourth embodiment of the present invention, and corresponds to FIG. 2.

FIG. 10 is a view that depicts the principal components of the refrigerant circuit of an air conditioner 301 according to the fourth embodiment of the present invention.

In the air conditioner 301, some of the plurality of utilization units used as switchable cooling and heating devices in the air conditioner 201 of the third embodiment are used as cooling only devices. Herein, the constitution of the heat source unit 2 and the utilization units are the same as that in the third embodiment, but the symbols of the utilization unit including a cooling only device is labeled with the 300 series (i.e., utilization unit 303).

Specifically, in the utilization units 3 excepting the utilization unit 303 including the cooling only device, the first refrigerant gas piping 26 of the heat source unit 2 and the utilization side heat exchangers 32 of the utilization units 3 are connected via a connecting refrigerant circuit 307, and the refrigerant liquid piping 25 of the heat source unit 2 and the utilization side expanding means V7 of the utilization units 3 are connected via the connecting refrigerant circuit 307. However, in the utilization unit 303, the second refrigerant gas piping 28 of the heat source unit 2 and a utilization side heat exchanger 332 of the utilization unit 303 are connected via the connecting refrigerant circuit 307, and the refrigerant liquid piping 25 of the heat source unit 2 and a utilization side expanding means V307 of the utilization unit 303 are connected via the connecting refrigerant circuit 307. Namely, the air conditioner 301 of the present embodiment differs from the third embodiment in that the utilization unit 303 used as the cooling only device is connected to the second refrigerant gas piping 28 and not the first refrigerant gas piping 26.

This air conditioner 301 can perform heating operation of the utilization units 3 and cooling operation of the utilization unit 303, as in the arrows attached to the refrigerant circuit showing the flow of refrigerant in FIG. 10. Specifically, in the utilization units 3, operation is performed by supplying high pressure refrigerant gas to the utilization side refrigerant circuits 3*a* of the utilization units 3 via the first refrigerant gas piping 26, condensing the refrigerant in the utilization side heat exchangers 32 as well as heating the indoor air, and returning the condensed refrigerant liquid to the refrigerant liquid piping 25. In the utilization unit 303, operation is performed by supplying the refrigerant liquid to a utilization side refrigerant circuit 303*a* of the utilization unit 303 via the refrigerant liquid piping 25 or the connecting refrigerant circuit 307, evaporating the refrigerant in the utilization side heat exchanger 332 as well as cooling the indoor air, and returning the evaporated low pressure refrigerant gas to the second refrigerant gas piping 28.

Thus, in the air conditioner 301 of the present embodiment, the connecting units 4 of the first embodiment are not used, and the utilization units 3, 303 can perform simultaneous cooling and heating operation; consequently, the valve operation for switching between cooling and heating (e.g., the operation of the valves V8, V9, and V10 in the first embodiment) is not needed, and the time for the operation of switching between cooling and heating can be shortened. In addition, the startup time can also be shortened because the operation of valves during startup of the air conditioner 301 can be reduced.

Furthermore, if the air conditioner is installed in an architectural structure like a building, then the utilization units installed in the server room may be used as the cooling only devices; however, even in such a case, they can be used as cooling only devices capable of continuously performing cooling operation, regardless of the operational state of other utilization units, by just connecting the utilization units to the refrigerant liquid piping 25 and the second refrigerant gas piping 28 of the heat source unit 2 as in the utilization unit 303.

Other Embodiments

The above explained an embodiment of the present invention based on the drawings, but the specific constitution is not limited to these embodiments, and it is understood that variations and modifications may be effected without departing from the spirit and scope of the invention.

For example, the first and second embodiments explained the refrigerant circuit of a simultaneous cooling and heating device, but the same effect is obtained even if a switchable cooling and heating device does not include the connecting unit.

INDUSTRIAL FIELD OF APPLICATION

By using the present invention, the check valve provided in the first refrigerant gas piping of the heat source unit for the conventional simultaneous cooling and heating device can be eliminated because the second switching means is provided, and the auxiliary heat exchanger can also be actuated as the evaporator. Thereby, a heat source unit can be provided capable of being used in either the air conditioner for switchable cooling and heating operation or the air conditioner for simultaneous cooling and heating operation.

What is claimed is:

1. A heat source unit comprising:

a compressing means for compressing refrigerant gas;

a main heat exchanger that functions as an evaporator or a condenser of the refrigerant;

an auxiliary heat exchanger connected in parallel with said main heat exchanger relative to a refrigerant flow direction and that functions as an evaporator or a condenser of the refrigerant;

a refrigerant liquid piping configured to connect to a connecting refrigerant circuit;

a first refrigerant gas piping configured to deliver refrigerant flow between the connecting refrigerant circuit and said compressing means;

a second refrigerant gas piping configured to deliver the refrigerant gas from the connecting refrigerant circuit to an intake side of said compressing means;

a main refrigerant switching means connected between said refrigerant liquid piping and said main heat exchanger;

an auxiliary refrigerant switching means connected between said refrigerant liquid piping and said auxiliary heat exchanger;

a first switching means operable between said main heat exchanger, said compressing means, said first refrigerant gas piping and said second refrigerant gas piping configured for switching between a first state and a second state, such that in said first state:

a refrigerant gas side of said main heat exchanger is connected to a discharge side of said compressing means, the intake side of said compressing means is connected to said first refrigerant gas piping, and low pressure refrigerant gas is made to be taken into the compressing means, and in said second state:

a refrigerant gas side of said main heat exchanger is connected to the intake side of said compressing means, the discharge side of said compressing means is connected to said first refrigerant gas piping, and high pressure refrigerant gas is made to be discharged from the compressing means;

and a second switching means operable between said auxiliary heat exchanger and said compressing means configured for switching between a state in which a refrigerant gas side of said auxiliary heat exchanger is connected to the discharge side of said compressing means, and a state in which a refrigerant gas side of said auxiliary heat exchanger is connected to the intake side of said compressing means, said first refrigerant gas piping being configured to deliver the refrigerant gas from the connecting refrigerant circuit to said first switching means, and configured to deliver the refrigerant gas from said first switching means to the connecting refrigerant circuit.

2. An air conditioner, comprising:

said heat source unit as recited in claim 1 including a heat source side refrigerant circuit;

a plurality of utilization side refrigerant circuits that each include a utilization side heat exchanger and a utilization side expanding means; and said connecting refrigerant circuit connected to said heat source side refrigerant circuit and said utilization side refrigerant circuits;

wherein, the refrigerant liquid piping is connected to the refrigerant liquid side of said utilization side expanding means via said connecting refrigerant circuit;

the first refrigerant gas piping of said heat source side refrigerant circuit is connected so that the high pressure refrigerant gas can be delivered to the refrigerant gas side of said utilization side heat exchangers via said connecting refrigerant circuit; and the second refrigerant gas piping of said heat source side refrigerant circuit is connected so that the low pressure refrigerant gas can return from said utilization side refrigerant circuits to the heat source side refrigerant circuit via said connecting refrigerant circuit.

3. An air conditioner, comprising:

said heat source unit as recited in claim 1 including a heat source side refrigerant circuit;

a plurality of utilization side refrigerant circuits that each include a utilization side heat exchanger and a utilization side expanding means; and said connecting refrigerant circuit connected to said heat source side refrigerant circuit and said utilization side refrigerant circuits;

wherein, the refrigerant liquid piping is connected to the refrigerant liquid side of said utilization side expanding means of said utilization side refrigerant circuits via said connecting refrigerant circuit;

the first refrigerant gas piping of said heat source side refrigerant circuit is connected to said utilization side heat exchangers of said utilization side refrigerant circuits via said connecting refrigerant circuit; and the second refrigerant gas piping of said heat source side refrigerant circuit is constituted so that it is not connected to said connecting refrigerant circuit and refrigerant gas does not flow therein.

4. An air conditioner, comprising:

said heat source unit as recited in claim 1 including a heat source side refrigerant circuit;

a plurality of utilization side refrigerant circuits that each include a utilization side heat exchanger and a utilization side expanding means; and said connecting refrigerant circuit connected to said heat source side refrigerant circuit and said utilization side refrigerant circuits;

wherein, the refrigerant liquid piping is connected to the refrigerant liquid side of said utilization side expanding means of each of said utilization side refrigerant circuits via said connecting refrigerant circuit;

the second refrigerant gas piping of said heat source side refrigerant circuit is connected to the utilization side heat exchanger of some of said plurality of utilization side refrigerant circuits via said connecting refrigerant circuit; and the first refrigerant gas piping of said heat source side refrigerant circuit is connected to said utilization side heat exchangers of said other utilization side refrigerant circuits via said connecting refrigerant circuit.

5. The heat source unit as recited in claim 1, wherein said main heat exchanger and said auxiliary heat exchanger are heat exchangers that use water as the heat source and exchange heat with the refrigerant; and a water side of said main heat exchanger and a water side of said auxiliary heat exchanger are connected in series.

6. The heat source unit as recited in claim 1, wherein a heat source water inlet is respectively provided on an upper side of said main heat exchanger and on an upper side of said auxiliary heat exchanger; and a heat source water outlet is respectively provided on a lower side of said main heat exchanger and on a lower side of said auxiliary heat exchanger.

* * * * *